US007121675B2

(12) United States Patent
Ter-Hovhannisian

(10) Patent No.: US 7,121,675 B2
(45) Date of Patent: Oct. 17, 2006

(54) LOW TEMPERATURE LED LIGHTING SYSTEM

(76) Inventor: Artak Ter-Hovhannisian, 606 E. Santa Anita, Apt. D, Burbank, CA (US) 91501

( * ) Notice: Subject to any disclaimer, the term of this patent is extended or adjusted under 35 U.S.C. 154(b) by 148 days.

(21) Appl. No.: 10/339,960

(22) Filed: Jan. 10, 2003

(65) Prior Publication Data

US 2003/0137828 A1 Jul. 24, 2003

Related U.S. Application Data

(60) Provisional application No. 60/347,617, filed on Jan. 10, 2002.

(51) Int. Cl.
*F21V 33/00* (2006.01)
*F25D 23/00* (2006.01)

(52) U.S. Cl. ..... 362/92; 62/264

(58) Field of Classification Search ..... 362/92, 362/249, 235, 800, 125, 126, 240, 433, 133; 62/264, 249; 312/223.5
See application file for complete search history.

(56) References Cited

U.S. PATENT DOCUMENTS

| | | | | |
|---|---|---|---|---|
| 4,667,481 | A * | 5/1987 | Watanabe et al. | 62/235 |
| 4,707,684 | A * | 11/1987 | Janke et al. | 62/131 |
| 4,748,545 | A | 5/1988 | Schmitt | |
| 4,872,317 | A * | 10/1989 | Reed | 62/135 |
| 4,940,921 | A | 7/1990 | Helling et al. | |
| 5,111,606 | A * | 5/1992 | Reynolds | 40/661.02 |
| 5,233,773 | A * | 8/1993 | Reynolds | 40/661.03 |
| 5,301,508 | A * | 4/1994 | Kahl et al. | 62/3.62 |
| 5,343,712 | A * | 9/1994 | Gowan | 62/126 |
| 5,471,372 | A * | 11/1995 | Mamelson et al. | 362/92 |
| 5,732,563 | A * | 3/1998 | Bethuy et al. | 62/139 |
| 5,879,070 | A | 3/1999 | Severloh | |
| 5,893,627 | A | 4/1999 | Tague | |
| 5,895,111 | A | 4/1999 | Santosuosso et al. | |
| 5,937,666 | A | 8/1999 | Trulaske, Sr. | |
| 6,170,273 | B1 * | 1/2001 | Bosi | 62/127 |
| 6,188,185 | B1 * | 2/2001 | Ter-Hovhannisian et al. | 315/312 |
| 6,283,612 | B1 | 9/2001 | Hunter | |
| 6,578,979 | B1 * | 6/2003 | Truttmann-Battig | 362/92 |

FOREIGN PATENT DOCUMENTS

| | | | |
|---|---|---|---|
| DE | 298 14 243 U1 * | 11/1998 | |
| EP | 0 971 186 A2 * | 6/1999 | |
| EP | 0971 186 A2 | 6/1999 | |

* cited by examiner

*Primary Examiner*—Sandra O'Shea
*Assistant Examiner*—Bao Q. Truong
(74) *Attorney, Agent, or Firm*—Kelly Lowry & Kelley, LLP

(57) ABSTRACT

A lighting system for low temperature environments includes a plurality of light emitting diodes attached to a support member mounted within a refrigeration unit or the like for illuminating contents thereof. A reflector is disclosed adjacent to the light emitting diodes for dispersing the light therefrom. A light transmitting cover overlies the light emitting diodes, and preferably includes non-planar surfaces for dispersing light onto objects within the refrigeration unit. A power supply converts alternating current voltage to a lower direct current voltage for powering the light emitting diodes in a safe manner.

25 Claims, 6 Drawing Sheets

FIG. 8
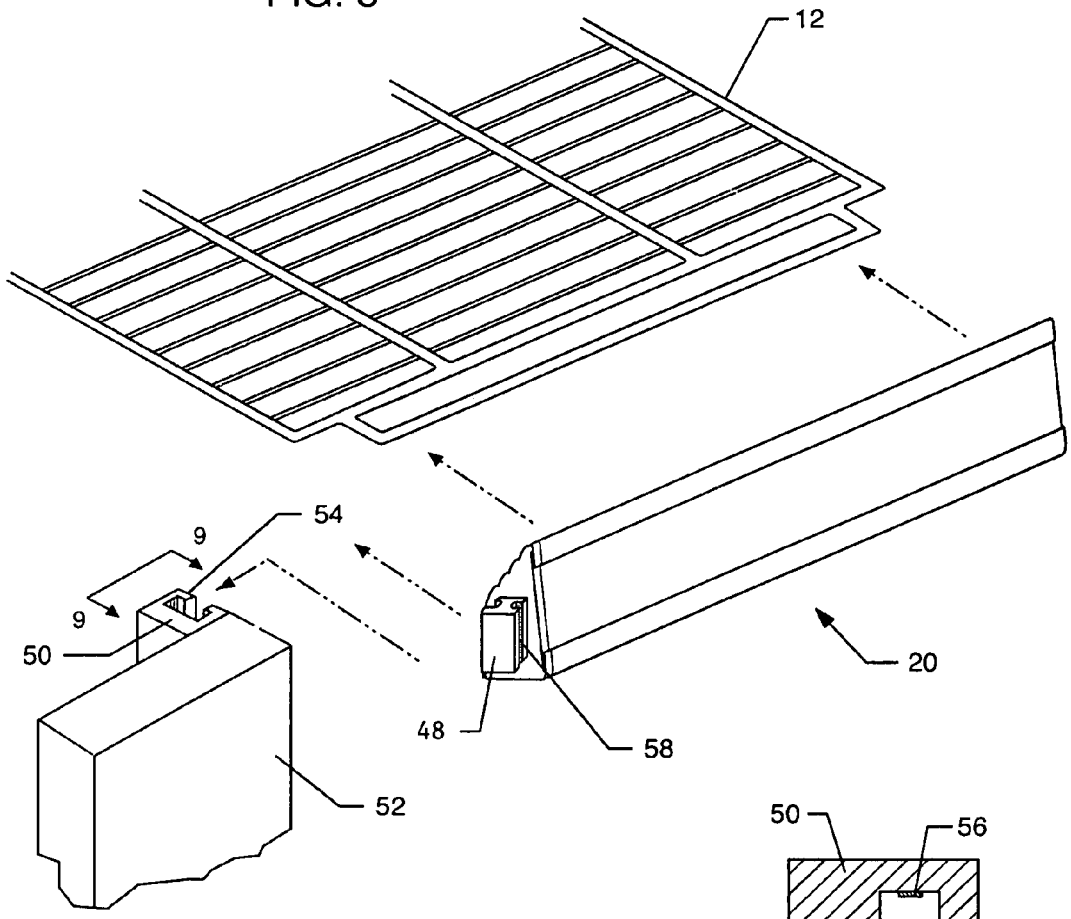
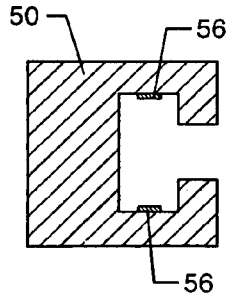
FIG. 9

LOW TEMPERATURE LED LIGHTING SYSTEM

RELATED APPLICATION

This application claims priority from U.S. Provisional Application Ser. No. 60/347,617, filed Jan. 10, 2002.

BACKGROUND OF THE INVENTION

This invention relates to lighting systems. More particularly, the present invention relates to a light emitting diode lighting system which operates in a reduced temperature environment, such as in a refrigerator or freezer unit.

In the grocery store, frozen foods such as juices, ice cream and vegetables, as well as those which need to be maintained at lowered temperatures such as diary products and fresh meat, must be stored in refrigeration units. The refrigeration units which contain these products must be properly lit as the associated shelving and doors create shadows or otherwise block outside ambient light from entering the refrigeration unit.

Flourescent lights have been used in such applications because the flourescent tubes are brighter and generate less heat than incandescent bulbs. However, use of flourescent lights has many drawbacks. Flourescent lights have filaments at each end which output a frequency and generate heat when an appropriate amount of current and voltage applied. The heated filaments warm a mixture of xenon, argon and krypton gas within the flourescent tube causing it to fire and generate light. It is difficult to fire and continue to keep flourescent tubes lit in low temperature environment applications as the mixture of gas must reach and maintain a certain elevated temperature to fire and remain lit. The cold environment acts to lower the temperature of the gas mixture within the flourescent bulb. In fact, flourescent tubes cannot be started in sub-zero temperatures and are very inefficient in colder temperatures above zero. Higher frequencies have been applied to the flourescent tubes to cause the gas mixture to continually generate light, however the high frequency causes electromagnetic interference (EMI) which is costly to filter. Unfiltered EMI caused by the generated high frequencies can cause nearby electronic devices to malfunction or even fail. The flourescent tube filaments are easily broken by vibration and from extreme variations from hot to cold, resulting in a shorter operational life span of the flourescent tubes. In order to partially resolve the problem of operating flourescent bulbs in a cold environment, a surrounding lense and insulator has been disposed around the flourescent tubes' filaments to at least partially retain the heat generated by the flourescent tube filaments.

Flourescent tubes present additional problems when used in cold environment applications. The filaments of the flourescent tubes are easily burnt or broken, and the thin-walled glass used in the flourescent tubes is susceptible to breakage. Flourescent tubes have rated operational lives of only 1,500 to 5,000 hours. Thus, the tubes must frequently be replaced. In fact, it is customary for retailers such as grocery stores to have maintenance contracts wherein all of the flourescent tubes in the refrigeration units are replaced on a schedule well before the rated operational lives of the flourescent tubes so that the service company is not constantly called to replace individual flourescent tubes which have burnt out. Such maintenance increases the cost of operating the refrigeration units.

Ballasts are used in flourescent lighting systems to convert the supplied alternating current to the desired frequency.

These ballasts are usually quite large and in their smallest form are fitted into the mullion, or dividing frame, of the refrigeration unit's doors. As either 110V to 240V of alternating current is used to power the flourescent systems, the design of the systems must be approved for safety. Such approval can be time consuming and costly.

Due to the size of the ballasts and the flourescent tubes, they are not mounted horizontally on the shelves, but rather they are necessarily positioned vertically along the mullion of the doors or frame of erect or free standing refrigeration units. This positioning, as well as the inherent limits of the flourescent tubes light output, creates an uneven lighting across the shelves of the display. For example, the shelving closest to the flourescent tubes has as much as three hundred percent more light than that portion of the shelving in the middle of the door which is between the vertical flourescent tube banks. Due to the size of the flourescent tube banks, the shelving must be a considerable distance from the doors so that the light from the flourescent tube banks is not shielded by posts of the shelving and product closest to the lights.

In open-display refrigeration units, the shelving must necessarily be stepped and staggered with shelves of less width on top and shelves of greater width on the bottom so as not to shield the lower shelving from the flourescent tubes which are positioned along the top of the unit. Usually, only one bank of flourescent tubes is used along the top of the refrigeration unit since placing flourescent tube banks on each shelf would occupy too much shelf space and pose safety concerns.

Another problem associated with the use of flourescent tubes is that the flourescent tubes are produced in pre-set lengths of one foot increments. The designers of refrigeration units must conform their units to these lengths or heights so that the product within the units is adequately lit. This results in ineffective use of the corners and other odd-sized areas of the store, reducing the amount of shelf space available to store and display goods. Shelf space is tantamount not only to the grocery store, but also the suppliers as an increase in only a few inches of shelf space can translate into much more product being displayed and eventually sold. Limiting the shelf space results in lost profits.

Still another problem associated with flourescent tubes is that their thin walls can easily be broken or shattered. The mercury within the flourescent tubes is a health concern. Also, the broken shards of glass is potentially dangerous to consumers within the retail establishment.

In low temperature environments, such as refrigerators and freezers, flourescent bulbs present a particularly costly drawback in that the flourescent bulbs create a tremendous amount of heat. Such heat must be removed from the environment by the compressors, putting strain on the compressors and increasing overall energy costs.

Accordingly, there is a need for an improved lighting system which operates efficiently in low temperature environments such as refrigeration units and the like. What is also needed is a low temperature lighting system which has a longer operational life and reduced maintenance costs in comparison with prior systems. What is further needed is a lighting system which is compact, durable, produces very little heat output, and is not prone to breakage and the emission of noxious gases. Additionally, a low temperature lighting system is needed which occupies less space and more evenly distributes light across the refrigeration unit. Such a system should optimally be flexible in length or height to accommodate the individual needs of the store. Moreover, a low temperature lighting system is needed which is capable of being placed horizontally on a shelf of the refrigeration unit without concern of space constraints or electrocution. The present invention fulfills these needs and provides other related advantages.

SUMMARY OF THE INVENTION

The present invention resides in a lighting system used in lower temperature environments, such as refrigeration or freezer units and the like. The present invention generally comprises a plurality of light emitting diodes attached to a support member mounted within a refrigeration unit for illuminating the contents thereof. Light emitting diodes (LED's) are electronic components which do not have a filament like a light bulb, therefore vibration does not effect an LED's performance. Light is electronically emitted. LED's have a very long life, approximately 100,000 to 150,000 hours or 10–15 years of constant operation. They are extremely energy efficient and consume very little power. Also, LED's produce very little heat. LED's can be placed on a support member, such as a printed circuit board (PCB) and occupy very little space.

In a particularly preferred embodiment, the plurality of light emitting diodes are formed in an array on a circuit board which is attached to a support member. The support member is mounted within a refrigeration unit for illuminating the contents thereof. Preferably, the light emitting diodes are formed in at least one linear array. A reflector is disposed adjacent to the light emitting diodes for dispersing the light therefrom. Typically, the reflector comprises angled reflective walls disposed adjacent to the light emitting diodes and extending substantially the length of the linear array.

A light transmitting cover typically overlies the light emitting diodes. The cover is preferably configured to include non-planar surfaces for dispersing the light onto objects within the refrigeration unit.

The support member may be mounted within the refrigeration unit in a number of manners. For example, the support may be mounted coplanar to refrigeration unit shelf with brackets removably attached to the shelf. Alternatively, the support may be positioned a predetermined distance from and perpendicular to the refrigeration unit shelf by mounting the frame to a refrigeration mullion. Multiple supports bearing arrays of light emitting diodes may be electrically connected to one another.

A power supply is operably connected to the light emitting diode array. The power supply converts alternating current voltage to a lower direct current voltage. In one embodiment, an end of the support includes a protuberance extending from an end thereof which is configured to slidably fit within a channel of a track attached to the refrigeration unit. The protuberance preferably includes electrodes which contact electrodes within the track when the protuberance is fitted into the channel of the track in order to supply power to the light emitting diodes.

Preferably, the light emitting diodes and associated electronic circuitry is sealed from the outer environment, such as by potting the light emitting diodes with a sealant, such as an epoxy resin or the like. In this manner, the cold and often humid atmosphere within the refrigeration unit will not adversely effect the lighting system of the present invention.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings:

FIG. 8 is a partially fragmented and exploded perspective view of a lighting unit used in accordance with the present invention attachable to a shelf and vertical track;

FIG. 9 is a cross-sectional view taken generally along line 9—9 of FIG. 8, illustrating electrodes within an internal cavity thereof;

DETAILED DESCRIPTION OF THE PREFERRED EMBODIMENTS

Figure 1:
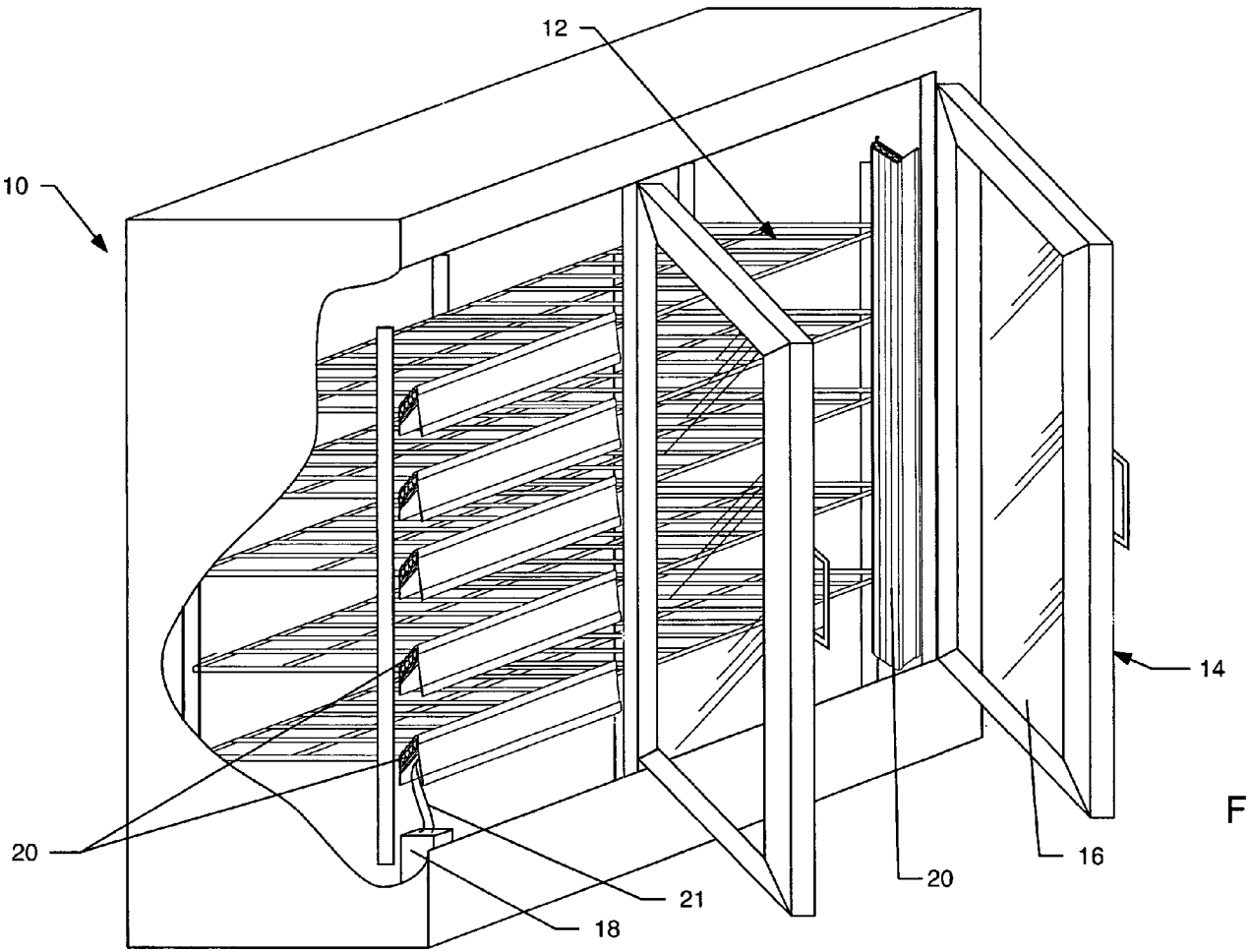
FIG. 1 is a perspective view of a refrigeration unit incorporating a LED lighting system embodying the present invention.

As shown in the drawings for purposes of illustration, the present invention is concerned with a lighting system used in low temperature applications, such as refrigeration units, freezer units the like.

With reference now to FIG. 1, an exemplary refrigeration unit 10 is illustrated which is commonly used in supermarkets and the like. Although such a refrigeration unit 10 is illustrated for exemplary purposes, it should be understood by those skilled in art that the present invention can be utilized in any number of different low temperature applications in different settings. However, the present invention is particularly adapted for use in such refrigeration units 10. Such refrigeration units 10 include a plurality of shelves 12 in an interior cavity thereof for storing refrigerated or frozen product. Doors 14 are provided at the front of the refrigeration unit 10 to allow access to the product. Typically, the doors 14 include glass or clear panes 16 to enable viewing of the contents of the refrigeration unit 10 without the need of first opening the door 14. Often times, such glass panes 16 are dual-pane for added insulation.

With continuing reference to FIG. 1, the lighting system of the present invention includes a power supply 18 which is adapted to convert 120 or 240 volt alternating current voltage to a lower direct current voltage, typically between 12–48 volts direct current. The use of such a low power eliminates most of the safety concerns associated with previously used flourescent tube lighting systems. The power supply 18 can be placed underneath or above the refrigeration unit 10, or in the mullion of the door frames which often contains the main electrical wiring for the refrigeration unit 10.

Figures 2, 3:
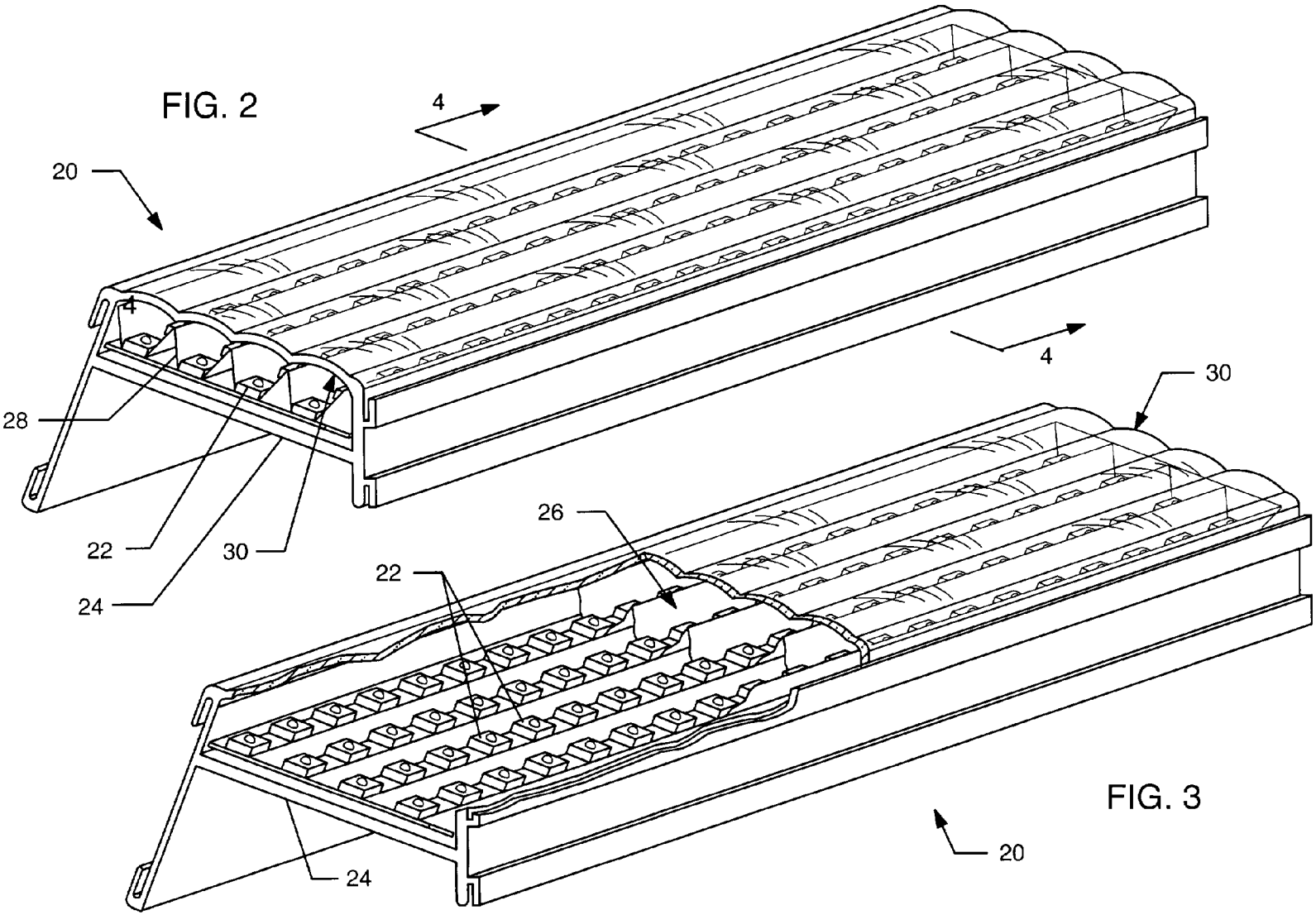
FIG. 2 is a perspective view of a LED lighting unit used in accordance with the present invention.
FIG. 3 is a partially fragmented perspective view similar to FIG. 2 illustrating an array of LED's positioned on a support mountable within the refrigeration unit and having a cover overlying the array.
Figure 4:
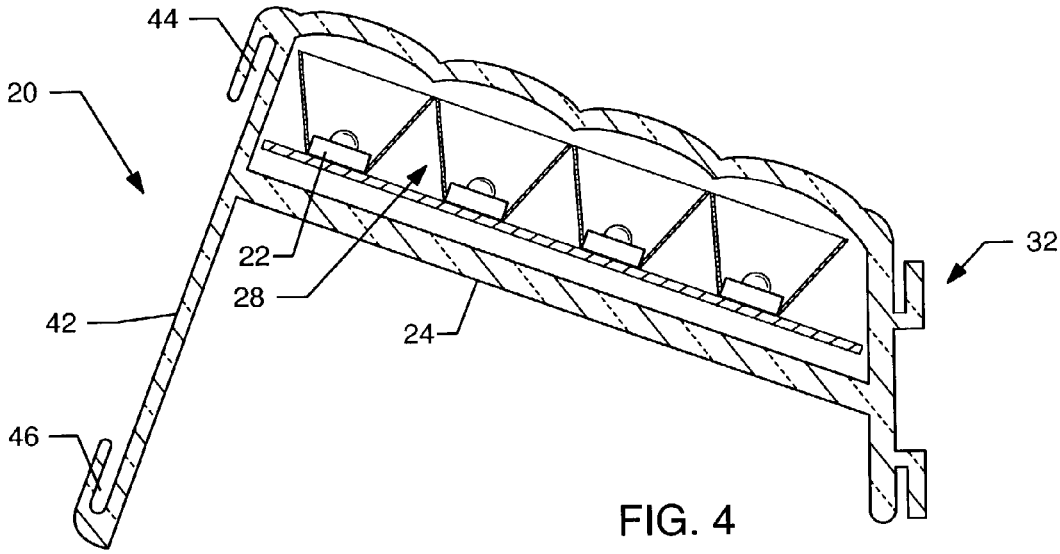
FIG. 4 is a cross-sectional view taken generally along the line 4—4 of FIG. 2, illustrating a reflector disposed adjacent to the LED's.

Typically a plurality, of lighting units or fixtures 20 are electrically connected to the power supply 18, such as by electrical leads 21 extending from the power supply or the like. A particularly preferred embodiment of a lighting unit 20 embodying the present invention is illustrated in FIGS. 2–4. Each light unit 20 is comprised of a plurality of LED's 22, which typically emit white light and are arranged in an array. As illustrated, the array of LED's is usually comprised of multiple linear arrays of LED's 22. However, the present invention is not limited to any particular configuration of LED's 22 so long as the number of LED's 22 is sufficient to illuminate the contents within the refrigeration unit to satisfy the needs of the user. Typically, the LED's 22 are assembled on a single or multi-unit printed circuit board (PCB) which is placed inside or attached to a support 24. Such PCB's may comprise a flexible circuit board. A heat sink (not shown) is typically attached to the PCB to draw any heat away from the LED's 22. Typically, such support 24 is comprised of a clear polycarbonate or acrylic material so as to be sufficiently durable, inexpensive, and not detract from viewing the product within the refrigeration unit 10.

LED's emit light in a fairly narrow angle, thus requiring a great number of LED's 22 to illuminate a given area, or the use of optics to disperse the light emitted from the LED's 22. In a particularly preferred embodiment of the invention, a reflector 26 is disposed adjacent to the LED's 22. Typically, a single reflector 26 having multiple angled walls 28 is configured to slide over the array of LED's 22 such that the light emitted from each LED 22 is reflected from the side walls 28 and dispersed over a greater angle. However, other reflectors 26 of different configurations may be utilized so long as the angle of light emitted is increased and dispersed so as to properly illuminate the contents within the refrigeration unit 10.

The unit 20 preferably also includes a transparent or translucent cover or shield 30 overlying the LED 22 array. The cover 30 may be attached to the support 24, or integrally formed therewith. Although the cover 30 may be planar, in a particularly preferred embodiment, the cover 30 is non-planar so as to form one or more lenses which optimize the light output of the LED's 22. The combination of the use of the reflector 26 and the optical lense 30 enable the use of fewer LED's 22 to illuminate a given area. However, it will be appreciated by those skilled in the art that such reflector 26 and shield 30 may be unnecessary if a sufficiently large amount of LED's 22 can be used to illuminate the given area.

Due to the fact that low temperature environments are often humid and potentially corrosive and damaging to electronics, the LED's 22 and accompanying circuitry is typically hermitically sealed from the environment. This may be done by hermitically sealing the LED's 22 within the support 24, such as by the use of a sealed cover 30 or the like. However, in a more particularly preferred embodiment, the LED's 22 are potted with epoxy or resin on the PCB to protect them from moisture. Alternatively, the LED's 22 can be protected using a conformal coating procedure which is well-known in the art but presently more complicated and expensive than potting.

With reference again to FIG. 1, the lighting units 20 are mounted in any number of ways within the refrigeration unit 10 so as to illuminate the product therein. In the exemplary refrigeration unit 10 illustrated, the lighting units 20 are typically mounted directed to the shelves 12 so as to direct light upwardly onto the product on each shelf 12, or vertically positioned within the refrigeration unit frame or mullion of the door frames.

Figure 5:
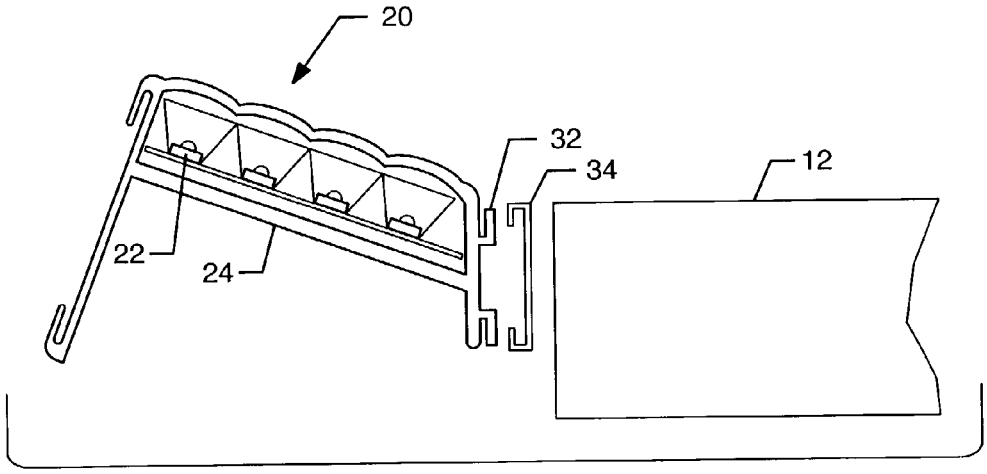
FIG. 5 is a cross-sectional view illustrating attachment of the LED unit of the present invention to a shelf using a mounting bracket.
Figure 6:
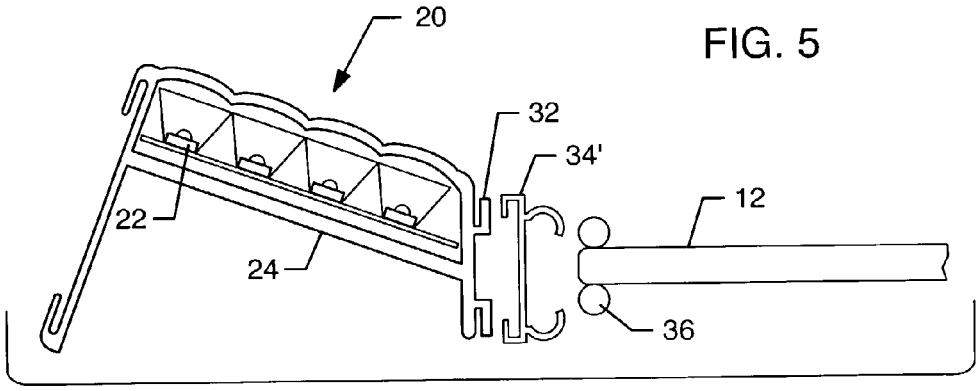
FIG. 6 is a cross-sectional view of the lighting system of the present invention being mounted to a wire shelf using a different mounting bracket.

With reference to FIGS. 4–7, the support 24 has an end thereof 32 which is formed so as to be removably received by a mounting bracket 34 which is directly attached to the shelf 12. As illustrated in FIG. 5, the mounting bracket 34 may be permanently attached to the shelf 12 by use of adhesive, screws, or the like. The lighting unit 20 is then removably attached to the mounting bracket 34 such as by snap-fit connection, mating, or slide-fit connection. With reference to FIG. 6, shelves comprised of a grid of wires are commonly used in which case the mounting bracket 34' is adapted to snap-fit onto the end wires 36 to provide a connective means for the lighting unit 20. Of course, the support 24 of the light unit 20 can also be configured to be directly attached to the shelf by snap-fit connection or the like.

Figure 7:
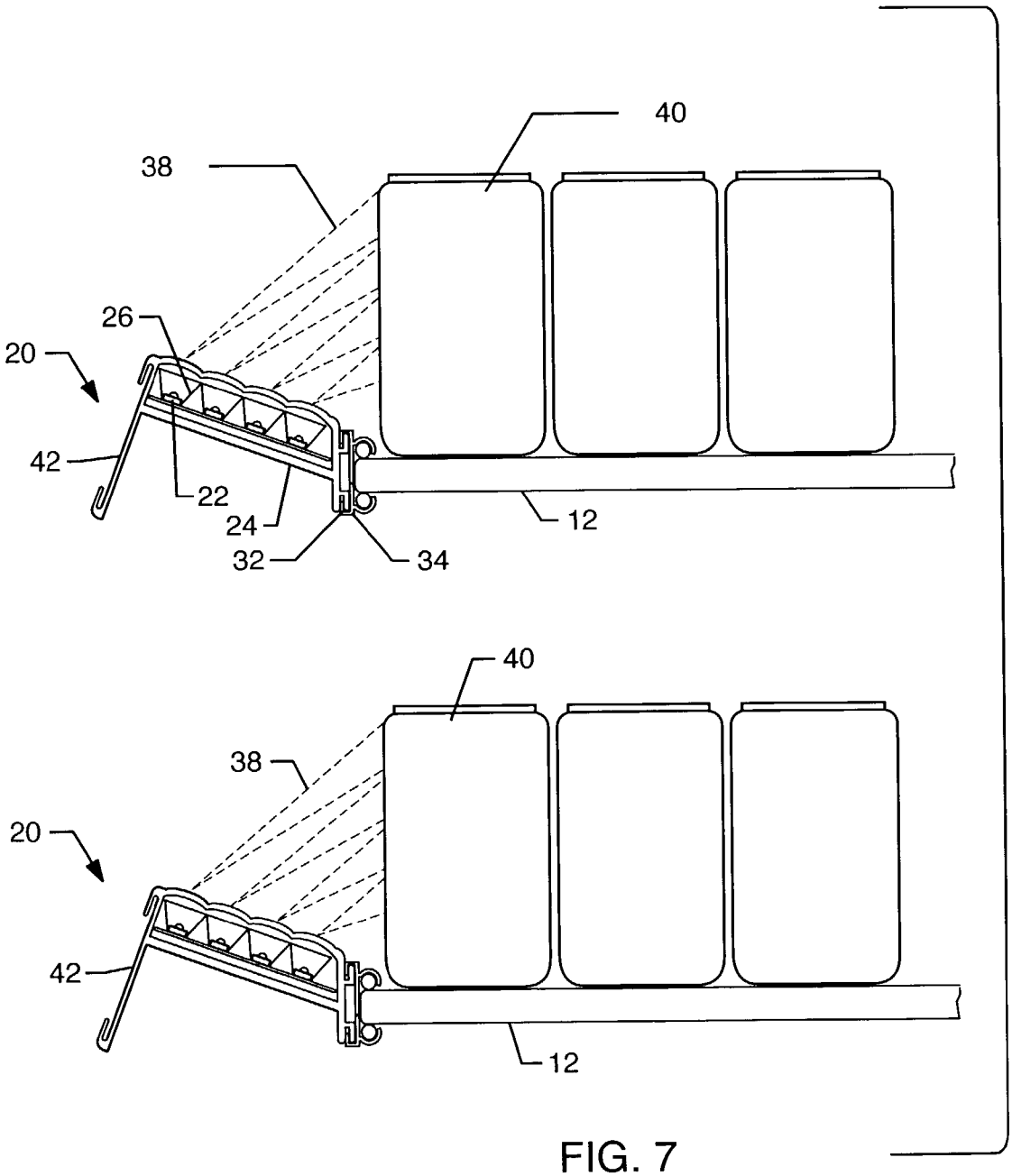
FIG. 7 is a side elevational view illustrating the lighting system of the present invention in use within a refrigeration unit.

With reference to FIG. 7, light units 20 of the present invention are shown attached to shelves 12 by means of the mounting brackets 34 so as to illuminate light 38 directly onto product 40 stored on the shelves 12 within the refrigeration unit 10. Due to the use of an LED array, the lighting units are of a relatively small size and can be directly attached to the front end of the shelves 12 which is not possible using current flourescent tube technology. In a particularly preferred embodiment, a front end 42 of the support 24 generally opposite the shelf 12 includes upper and lower grooves 44 and 46 which enable a price tag or product description tag (not shown) to be inserted therein.

The use of LED's 22 in the light units or fixtures 20 of the present invention provide much more freedom in placement of such light units 20 due to their relatively thin and small size. For example, the lighting units 20 could be placed directly within the glass panes 16 of a refrigeration unit door 14 to illuminate contents of the refrigeration unit 10. In other applications, such as an ice cream cooler, the lighting units 20 could be placed on the edge of the sliding horizontal door to illuminate the ice cream contents thereof. Currently, many current ice cream cases do not have a lighting system due to the space constraints and difficulty of lighting such units. In reach-in type open face coolers, overhead flourescent lamps are currently used, and the top shelves are made narrower than the bottom shelves so that light can be placed on the bottom shelves. However, the lighting system of the present invention solves this problem by placing light directly onto each individual shelf by connecting lighting units 20 at the front edge of each shelf, in a manner similar to that illustrated in FIGS. 5 and 6. The lighting system 10 of the present invention can also be used in deli, meat and bakery display cases of a supermarket as the lighting units 20 are very compact, hermetically sealed, and generate very little heat.

With reference now to FIGS. 8 and 9, a particularly preferred manner of powering and mounting the lighting units 20 is illustrated. A protuberance 48 is attached to or formed at an end of the unit 20. The protuberance 48 is configured to slidingly fit within a track 50 positioned perpendicular to the shelves 12 of the refrigeration unit 10. Typically, the track 50 is attached to the mullion 52 or other frame member of the refrigeration unit 10. Preferably, the track 50 is configured to have a T-shaped cavity 54 into which the mating T-shaped protuberance 48 is inserted so as to slide along the length of the track 50. With reference to FIG. 9, in a particularly preferred embodiment, electrodes 56 line an inner surface of the cavity 54 of the track 50 which contact electrodes 58 of the protuberance 48 in order to transmit power from the power supply 18 to the LED's 22 of the lighting unit 20. Thus, the lighting units 20 can be slid vertically within track 50 to be positioned co-planar with the shelf 12 and mounted thereto, as described above. Such a system enables the owner of the refrigeration unit to adjust the relative position of the shelves 12 and easily reposition the lighting units 20. Due to the relatively low power supplied to the units 20 the utilization of the electrodes 56 and 58 is not a safety concern.

Figure 10:
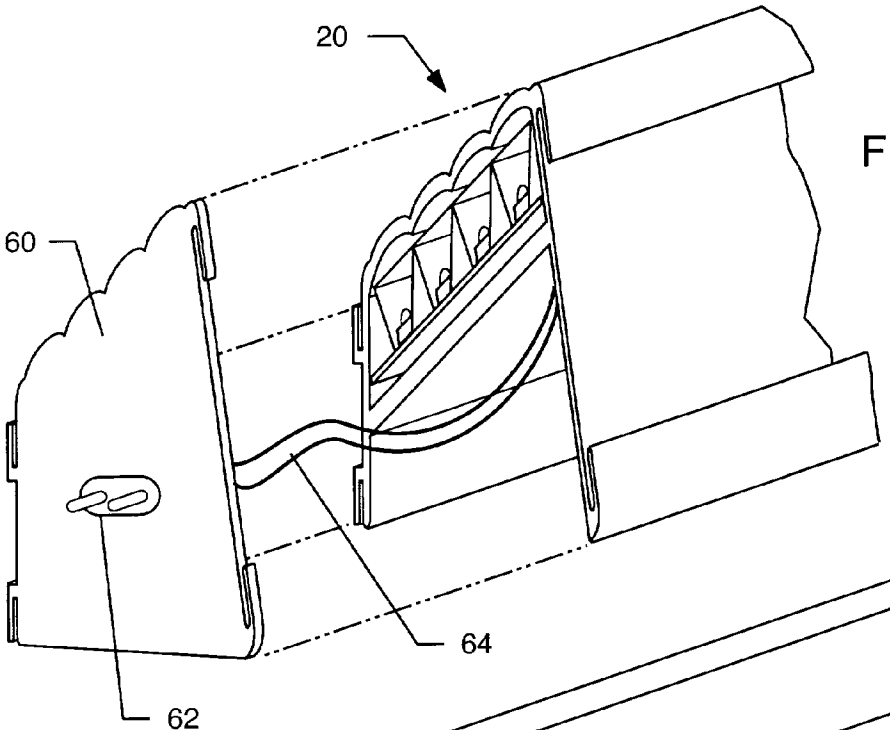
FIG. 10 is a partially exploded perspective view a lighting unit embodying the present invention having an end cap bearing an electrical connector.
Figure 11:
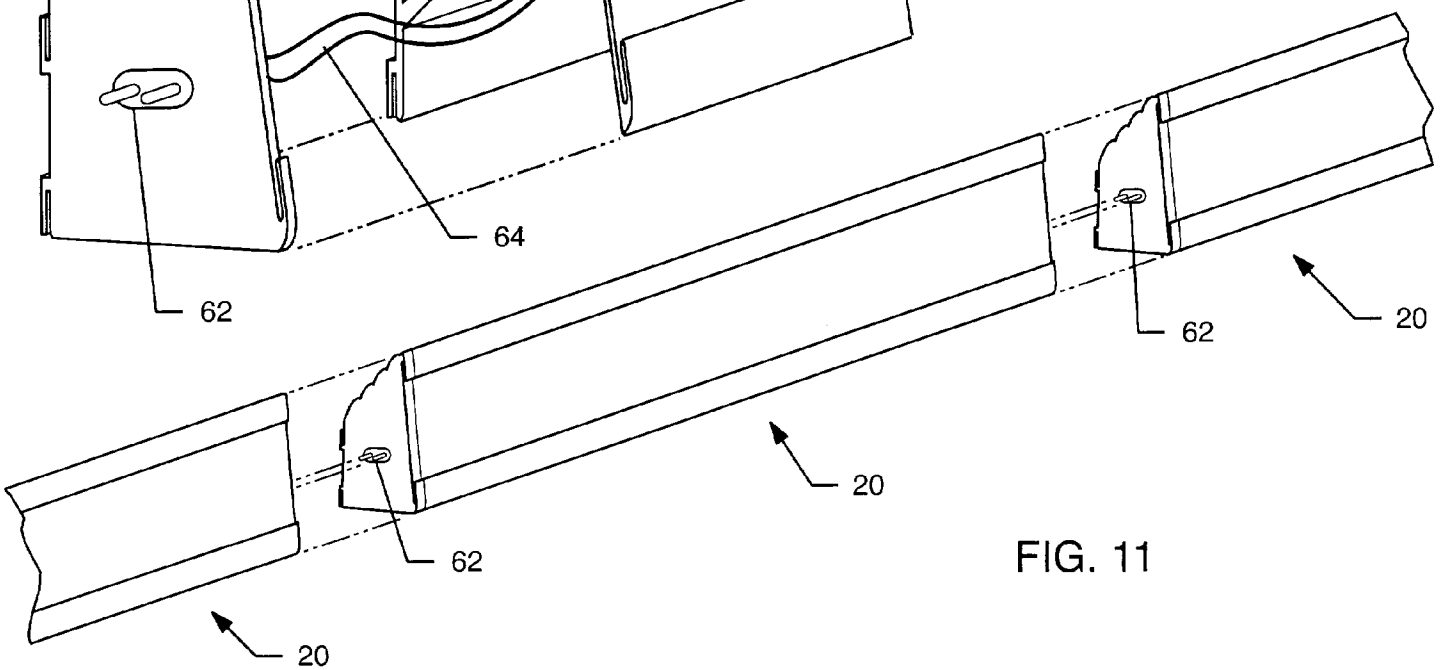
FIG. 11 is an exploded perspective view of multiple lighting units 20 of the present invention electrically connected with one another.

With reference now to FIGS. 10 and 11, although the lighting units 20 can be constructed to any length or configuration required for a particular application, in a particularly preferred embodiment, multiple lighting units 20 are utilized and electrically interconnected with one another. For example, a given refrigeration unit 10 may be approximately six feet in height. The lighting units 20 may only be three feet in length. Thus, two lighting units 20 are interconnected so as to provide power to each. Although this may be accomplished by wires and electrical connectors, such as pig tails extending from ends of the units 20, in a particularly preferred embodiment as illustrated, end caps 60 are attached to ends of the unit 20 and include electrical connectors, such as mating male electrical prongs 62 and a corresponding female adapter formed in an end plate of the adjacent lighting unit 20. Electrical leads 64 extend from the connector 62 to the LED array 22. The lighting units 20 are configured such that each unit, although interconnected, will operate independently from the other. Thus, a defective or non-working unit 20 will not affect the operation of the other units 20 in any manner.

The lighting system of the present invention is capable of producing equal or higher light output across refrigeration shelving than currently used neon or flourescent tube technology. Also, the LED system of the present invention immediately produces optimal light output, whereas flourescent tubes take many minutes to warm-up to optimal operating conditions. Additionally, the light of the lighting units 20 of the present invention is up to 20 times the life of conventional flourescent lamps and are flicker-free. Due to the relatively compact nature of the lighting units 20, they can be placed on the shelving, doors, or positioned on the frame or mullion of the refrigeration unit 10 as needed. Temperature concerns of the lighting system are eliminated as the lighting system of the present invention produces virtually no heat. The lighting system of the present invention can be utilized in reach-in refrigeration units, walk-in freezers and coolers, display cases, etc.

The lighting system of the present invention can also be used in non-food related refrigerated freezers and coolers, such as those used in pharmaceutical, laboratory and research use. In many cases, these refrigerated freezers and coolers required very low operating conditions. There is no known light that can operate efficiently in these conditions except for fiber optic light sources which are very expensive. The low cost of the lighting system of the present invention along with its simplicity and durability enables it to be used in these applications. The lighting units 20 of the present invention can operate in an environment having a temperature as low as −150° C. LED's have been found to operate more efficiently in lower temperatures. It is ideal for use in units to store blood, chemicals, medication, etc. that must be kept at very low temperatures.

Although several embodiments have been described in some detail for purposes of illustration, various modifications may be made without departing from the scope and spirit of the invention. Accordingly, the invention is not to be limited, except as by the appended claims.

What is claimed is:

1. A lighting system for a refrigeration unit storing perishable food product, comprising:

a plurality of light emitting diodes attached to a support member mounted within the refrigeration unit for illuminating the perishable food product stored within the refrigeration unit; and a power supply operably connected to the plurality of light emitting diodes;

wherein the power supply converts alternating current voltage to a lower direct current voltage.

2. The system of claim 1, including a reflector disposed adjacent to the light emitting diodes for dispersing the light from the light emitting diodes.

3. The system of claim 2, including a light transmitting cover overlying the light emitting diodes.

4. The system of claim 3, wherein the cover is configured to include non-planar surfaces for dispersing the light onto objects within the refrigeration unit.

5. The system of claim 1, wherein the plurality of light emitting diodes are formed in an array on a circuit board and potted with a sealant.

6. The system of claim 2, wherein the plurality of light emitting diodes are formed in at least one linear array.

7. The system of claim 6, wherein the reflector comprises angled reflective walls disposed adjacent to the light emitting diodes and extending substantially the length of the linear array.

8. The system of claim 1, wherein the support is mounted coplanar to a refrigeration unit shelf with brackets removably attached to the shelf.

9. The system of claim 1, wherein the support is positioned a predetermined distance from and perpendicular to a refrigeration unit shelf by mounting a frame to a refrigeration mullion.

10. The system of claim 1, wherein an end of the support includes a protuberance extending from an end thereof and configured to slidably fit within a channel of a track attached within a refrigeration unit.

11. The system of claim 10, wherein the protuberance includes electrodes which contact electrodes within the track when the protuberance is fitted into the channel of the track in order to supply power to the plurality of light emitting diodes.

12. A lighting system for a refrigeration unit storing perishable food product, comprising:

a plurality of light emitting diodes formed in an array on a circuit board attached to the support member mounted within a refrigeration unit for illuminating the product contents thereof;

a power supply operably connected to the light emitting diode array and capable of converting alternating current voltage to a lower direct current voltage;

a reflector disposed adjacent to the light emitting diodes for dispersing the light from the light emitting diodes; and a light transmitting cover overlying the light emitting diodes.

13. The system of claim 12, wherein the plurality of light emitting diodes are formed in at least one linear array, and wherein the reflector comprises angled reflective walls disposed adjacent to the light emitting diodes and extending substantially the length of the linear array.

14. The system of claim 12, wherein the support is mounted coplanar to a refrigeration unit shelf with brackets removably attached to the shelf.

15. The system of claim 12, wherein the support is positioned a predetermined distance from and perpendicular to a refrigeration unit shelf by mounting the frame to a refrigeration mullion.

16. The system of claim 12, wherein the cover is configured to include non-planar surfaces for dispersing the light onto objects within the refrigeration unit.

17. The system of claim 12, wherein an end of the support includes a protuberance extending from an end thereof and configured to slidably fit within a channel of a track attached within a refrigeration unit.

18. The system of claim 17, wherein the protuberance includes electrodes which contact electrodes within the track when the protuberance is fitted into the channel of the track in order to supply power to the plurality of light emitting diodes.

19. A lighting system for a refrigeration unit storing perishable food product, comprising:

a plurality of light emitting diodes formed in at least one linear array on a circuit board attached to the support member mounted within a refrigeration unit for illuminating the product contents thereof;

a power supply operably connected to the light emitting diode array and capable of converting alternating current voltage to a lower direct current voltage;

a reflector comprising angled reflective walls disposed adjacent to the light emitting diodes and extending substantially the length of the linear array for dispersing the light from the light emitting diodes; and a light transmitting cover overlying the light emitting diodes, the cover including non-planar surfaces for dispersing the light onto objects within a refrigeration unit.

20. The system of claim 19, wherein the support is mounted coplanar to a refrigeration unit shelf with brackets removably attached to the shelf.

21. The system of claim 19, wherein the support is positioned a predetermined distance from and perpendicular to a refrigeration unit shelf by mounting a frame to a refrigeration mullion.

22. The system of claim 19, wherein an end of the support includes a protuberance extending from an end thereof and configured to slidably fit within a channel of a track attached to a refrigeration unit.

23. The system of claim 22, wherein the protuberance includes electrodes which contact electrodes within the track when the protuberance is fitted into the channel of the track in order to supply power to the plurality of light emitting diodes.

24. A lighting system for a refrigeration unit storing perishable food product, comprising:

a plurality of light emitting diodes attached to a support member mounted within the refrigeration unit for illuminating the perishable food product stored within the refrigeration unit, wherein the plurality of light emitting diodes are formed in an array on a circuit board and potted with a sealant; and a power supply operably connected to the plurality of light emitting diodes.

25. A lighting system for low temperature environments, comprising:

a plurality of light emitting diodes attached to a support member mounted within a refrigeration unit for illuminating product stored within a refrigeration unit; and a power supply operably connected to the plurality of light emitting diodes;

wherein an end of the support includes a protuberance extending from an end thereof and configured to slidably fit within a channel of a track attached within a refrigeration unit; and wherein the protuberance includes electrodes which contact electrodes within the track when the protuberance is fitted into the channel of the track in order to supply power to the plurality of the light emitting diodes.

* * * * *